US010017894B2

(12) United States Patent
Strahle

(10) Patent No.: US 10,017,894 B2
(45) Date of Patent: Jul. 10, 2018

(54) CLEAN STATUS INDICATOR

(71) Applicant: David A. Strahle, Fenton, MI (US)

(72) Inventor: David A. Strahle, Fenton, MI (US)

( * ) Notice: Subject to any disclaimer, the term of this patent is extended or adjusted under 35 U.S.C. 154(b) by 325 days.

(21) Appl. No.: 14/822,523

(22) Filed: Aug. 10, 2015

(65) Prior Publication Data

US 2017/0045871 A1 Feb. 16, 2017

(51) Int. Cl.

| | |
|---|---|
| ***G05B 19/05*** | (2006.01) |
| ***D06F 39/00*** | (2006.01) |
| ***A47L 15/42*** | (2006.01) |
| ***A47L 15/00*** | (2006.01) |
| *A47L 15/50* | (2006.01) |
| *D06F 39/12* | (2006.01) |
| *D06F 33/02* | (2006.01) |

(52) U.S. Cl.

CPC ..... *D06F 39/005* (2013.01); *A47L 15/006* (2013.01); *A47L 15/4293* (2013.01); *A47L 15/4295* (2013.01); *A47L 15/4253* (2013.01); *A47L 15/4257* (2013.01); *A47L 15/50* (2013.01); *A47L 2301/06* (2013.01); *A47L 2401/04* (2013.01); *A47L 2401/18* (2013.01); *A47L 2501/26* (2013.01); *D06F 33/02* (2013.01); *D06F 39/125* (2013.01); *D06F 2202/04* (2013.01); *D06F 2202/10* (2013.01); *D06F 2216/00* (2013.01)

(58) Field of Classification Search

None

See application file for complete search history.

(56) References Cited

U.S. PATENT DOCUMENTS

| | | | | |
|---|---|---|---|---|
| 5,229,753 | A * | 7/1993 | Berg | A47L 15/4295 134/113 |
| 2005/0217904 | A1* | 10/2005 | Hughes | A45C 15/00 177/245 |
| 2011/0248609 | A1* | 10/2011 | Hopfl | A47L 15/006 312/228 |
| 2016/0063841 | A1* | 3/2016 | Schultz | G06F 13/4221 340/601 |

OTHER PUBLICATIONS

Chan, Automatic Electronic Dishwasher Clean/Dirty Indicator Device, U.S. Appl. No. 62/131,141.*

Bhogal; Nikhil, Connected Food Preparation System and Method of Use, May 5, 2015, U.S. Appl. No. 62/157,325.*

* cited by examiner

*Primary Examiner* — Mohammad Ali

*Assistant Examiner* — Vincent Chang

(74) *Attorney, Agent, or Firm* — Richard C. Vershave; Fraser Trebilcock Davis & Dunlap, PC

(57) ABSTRACT

A clean status indicator is disclosed for use with a cleaning device such as a dishwasher. At least one weight sensor may be configured to sense the weight of objects within the washing compartment. In some approaches at least one temperature sensor is configured to monitor a change of temperature occurring within a washing compartment. A visual display is positioned within a housing for conveying a clean/dirty status of objects within the washing compartment. A controller is in communication with the at least one sensor and the visual display. The controller includes a status logic receiving data from the at least one sensor to determine the clean/dirty status of objects within the washing compartment and display the clean/dirty status on the visual display.

17 Claims, 8 Drawing Sheets

CLEAN STATUS INDICATOR

BACKGROUND

Electronic devices such as automatic dishwashers are utilized to clean and sanitize items such as dishes, utensils, and other household items placed within. Such devices utilize an electronic controlled system of cycles that undertake at least a subset of wash, rinse and dry the objects placed within. The time required to run through a standard cleaning set of cycles, however, can encompass a substantial time. Therefore, it is unusual for users to sit and wait for the device to finish. Rather, it is commonplace for users to move onto other tasks while the device operates. Often, upon returning to the device, a user is left contemplating if it was run or not. Although manual methods such as feeling for the warmth of the dishes or looking for water pooling on the top of glasses in the case of a dishwasher may give some indication, it is often difficult to tell if the cleaning cycles were run and the contents are clean. Moreover, the method is hardly foolproof. For example, in the case of a dishwasher, an indication of slightly wet items may not be very helpful if the objects were rinsed prior to being loaded into the dishwasher.

Even when a user is aware that the device has completed the cleaning process, the process of unloading may become interrupted by other more pressing matters. Upon return, the user may be confronted with a partially loaded device such as a dishwasher and no idea of its clean/dirty status. Additionally, in large families or shared residences it is not unknown for an individual to open a device and remove only a subset of the retained items such as a glass, plate, or utensil that is immediately required. When another individual opens the device, they are again left attempting to discern the status of the contents. The tendency is often to simply run the device through another set of cycles to be safe. This is uneconomical and inefficient.

There have been advances in device designs to monitor the clean/dirty status of their contents, but these designs are incorporated into the physical structure of the new devices. Additionally, they are often defeated as soon as the door is opened for initial unloading and do not capture the concept of partial unloading at a first time and a further unloading at a second later time. Moreover, these devices are only available upon the purchase of a new device. The longevity of devices such as dishwashers means that these advances in technology won't find their way into the majority of people's kitchens for years to come. There are also products that may be inserted along with the dishes into the dishwasher washing compartment to indicate status. But similar to the manual checking described above, they require a physical interaction by the user that may be overlooked.

It may be desirable for an improved status indicator solution that may be installed and operated on the large number of existing devices presently operating in the market. It may also be desirable for a status indicator solution that minimizes user inputs and takes into consideration partial unloading of a device contents whether the device is new or pre-existing in the marketplace.

BRIEF DESCRIPTION OF THE DRAWINGS

Referring now to the drawings, exemplary illustrations are shown in detail. Although the drawings represent representative examples, the drawings are not necessarily to scale and certain features may be exaggerated to better illustrate and explain an innovative aspect of an illustrative example. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows.

DETAILED DESCRIPTION

A cleanliness status indicator such as that which may be used with a dishwasher or a washing machine is disclosed with the capability to be installed using either new devices or pre-existing devices and automatically indicate the clean/dirty status of the objects within the washing compartment. Moreover, the disclosed status indicator provides a customizable sensor system that may be tailored to individual devices and the habits of the individual users that install or use it.

Figure 1A:
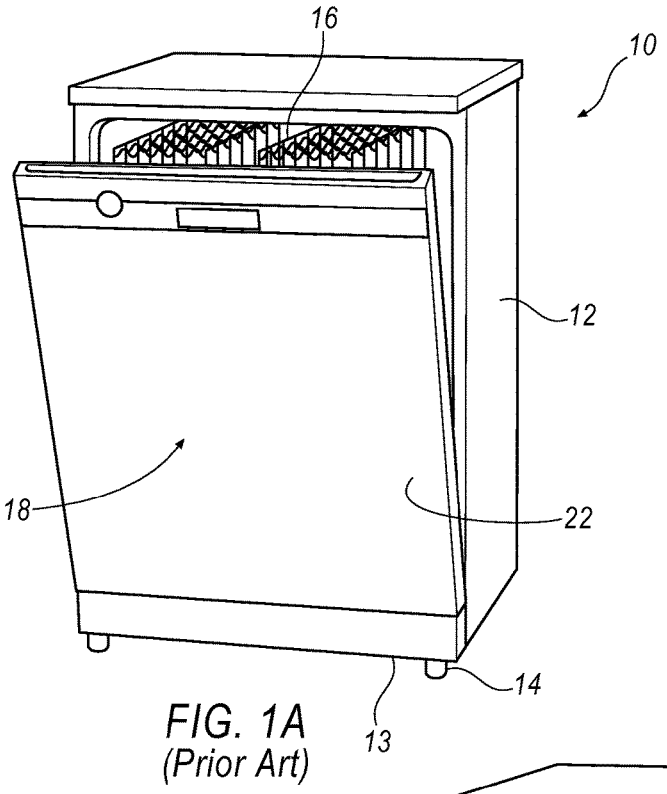
FIG. 1A (Prior Art)
FIG. 1*a* is an exemplary illustration of a dishwasher as a sample device in accordance with the prior art.
Figure 1B:
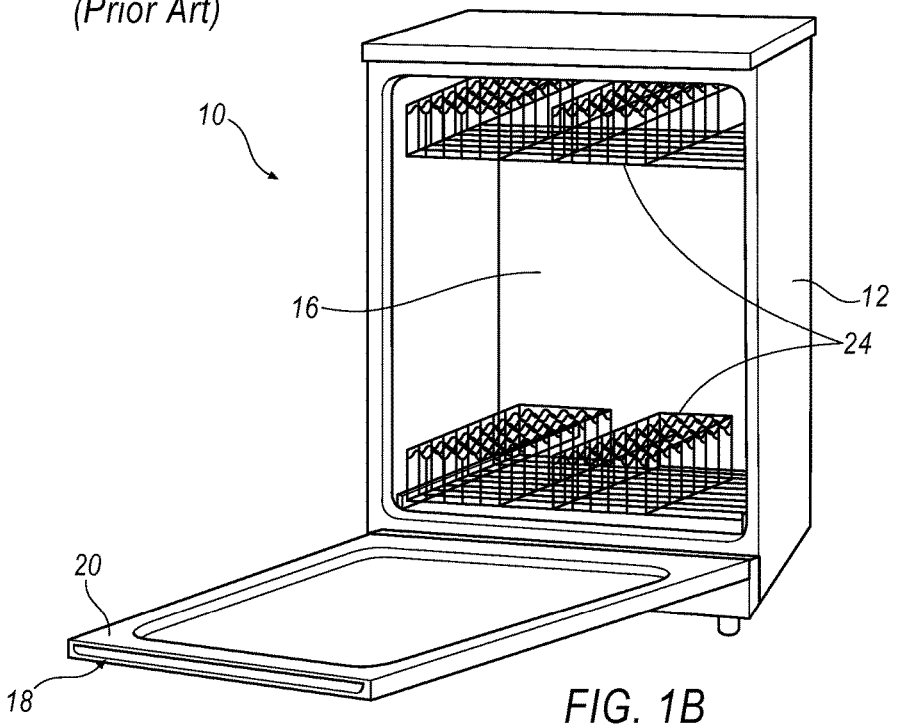
FIG. 1B (Prior Art)
FIG. 1*b* is an exemplary illustration of the dishwasher illustrated in FIG. 1*a* in accordance with the prior art, the dishwasher illustrated in an open position.

Referring now to FIG. 1*a*, a device such as a dishwasher 10 as known in the prior art is shown. The dishwasher 10 is intended for illustrative purposes only and it is understood that a wide variety of shapes and configurations are known. The dishwasher 10 includes a frame 12 with a base 13 having supporting feet 14. Although the supporting feet 14 may comprise adjustable height feet components, a variety of differing supporting feet 14 structures are known. The frame 12 defines a washing compartment 16 in its interior. The dishwasher 10 typically includes a door 18 having an interior door surface 20 (FIG. 1*b*) and an exterior door surface 22 (FIG. 1*a*). The dishwasher 10 may also include one or more movable racks 24 that allow for the storage of dishes, utensils, and other household objects for cleaning.

Figure 2:
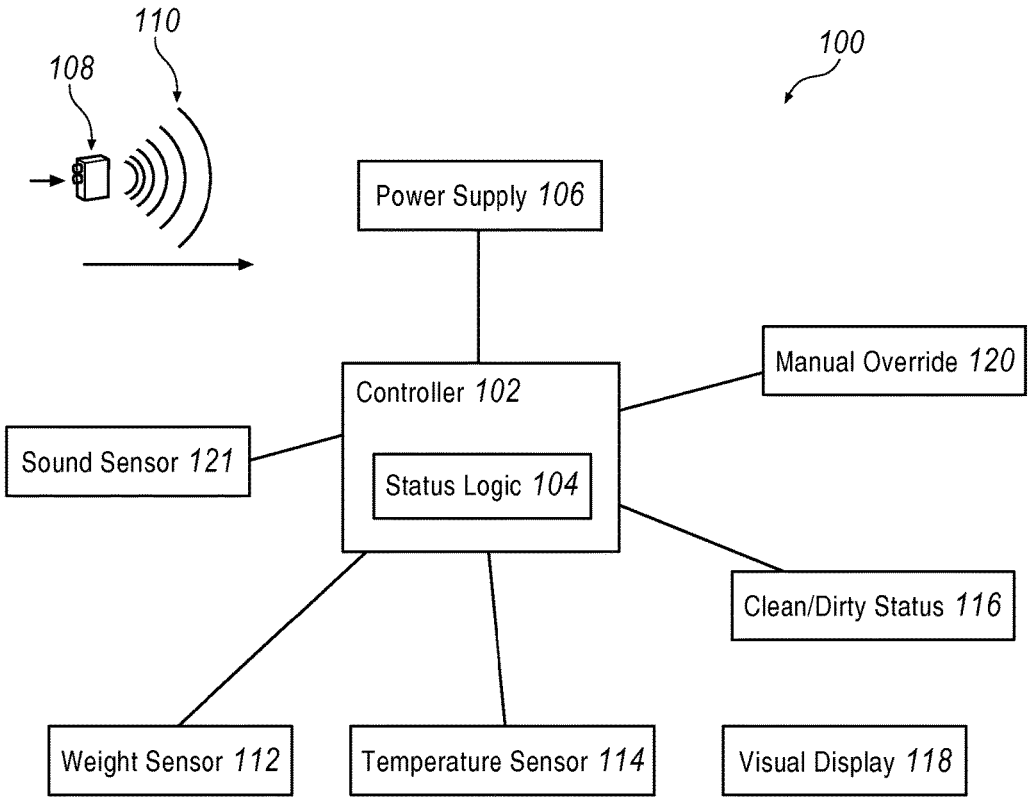
FIG. 2 is an exemplary schematic of a clean status indicator for a dishwasher acting as a sample device.

Referring now to FIG. 2, an exemplary schematic of a clean status indicator 100 is shown. The status indicator 100 may include a controller 102 including a status logic 104 embedded therein. The controller 102 may be powered by a power supply 106. In one exemplary arrangement, the power supply 106 may comprise a user replaceable battery. In another exemplary arrangement the power supply 106 may comprise a rechargeable battery. In still another exemplary arrangement, the power supply may comprise a wireless charging power supply. The use of a wireless charging power supply allows the status indicator 100 to be mounted on an existing dishwasher 10 without requiring ongoing battery replacement or recharging requirements. The wireless charging power supply 106 may be charged utilizing a remote positioned energy transfer unit 108 transferring energy to the power supply 108. In one exemplary arrangement, the wireless charging power supply 106 may receive energy from ambient WIFI signals or the like 110 that are commonly present in most household environments. This may significantly improve the ease of use and reduce maintenance.

The status indicator 100 may also include at least one weight sensor 112 in communication with the controller 102. The at least one weight sensor 112 is configured to sense the weight of objects within the washing compartment 16. In some cases, as discussed below, it may be desirable to also measure the addition of water to the washing compartment. The status indicator may also include at least one temperature sensor 114 configured to sense a change of temperature of the washing compartment 16 from a position exterior of the washing compartment 16 such as through communication with the exterior door surface 22 of a dishwasher 10 or within the washing compartment 16 itself as discussed in an example below. Sensor 114 does not necessarily have to be in contact with the dishwasher 10 so long as the sensor can determine an appropriate change in temperature within washing compartment 16 so that the occurrence of an appropriate device cleaning cycle may be determined. Thus, it can be positioned away from, but adjacent to the device. In some cases the status indicator 100 may also incorporate a sound sensor 121 that is keyed to identifying when device 10 is initially activated at the beginning of one or more cycles. The sensors may transmit their respective data either through a wired connection or wirelessly. In an exemplary arrangement, the at least one weight sensor 112 transmits weight data wirelessly to the controller 102, the at least one temperature sensor 114 transmits temperature data to the controller 102 through a wired connection and if utilized the sound sensor 121 transmits a triggering of a specific device operational sound through a wired connection. The weight sensors may comprise either active or passive sensors. In an exemplary arrangement, one or more of the sensors may comprise a passive sensor such as a radio frequency identification device ("RFID") sensor so that it can be positioned remotely without the need for an additional power supply.

The status logic 104 within the controller 102 may be configured to receive the data from each of the sensors. The status logic 104 is configured to utilize this data to determine a clean/dirty status 116 and display the clean/dirty status 116 on a visual display 118. The visual display 118 may include any of a variety of lights, textual displays, graphical displays, or any variety of known status indicators. The controller 102 may also be in communication with a manual override 120 element allowing a user to manually set the clean/dirty status 116.

Figure 3:
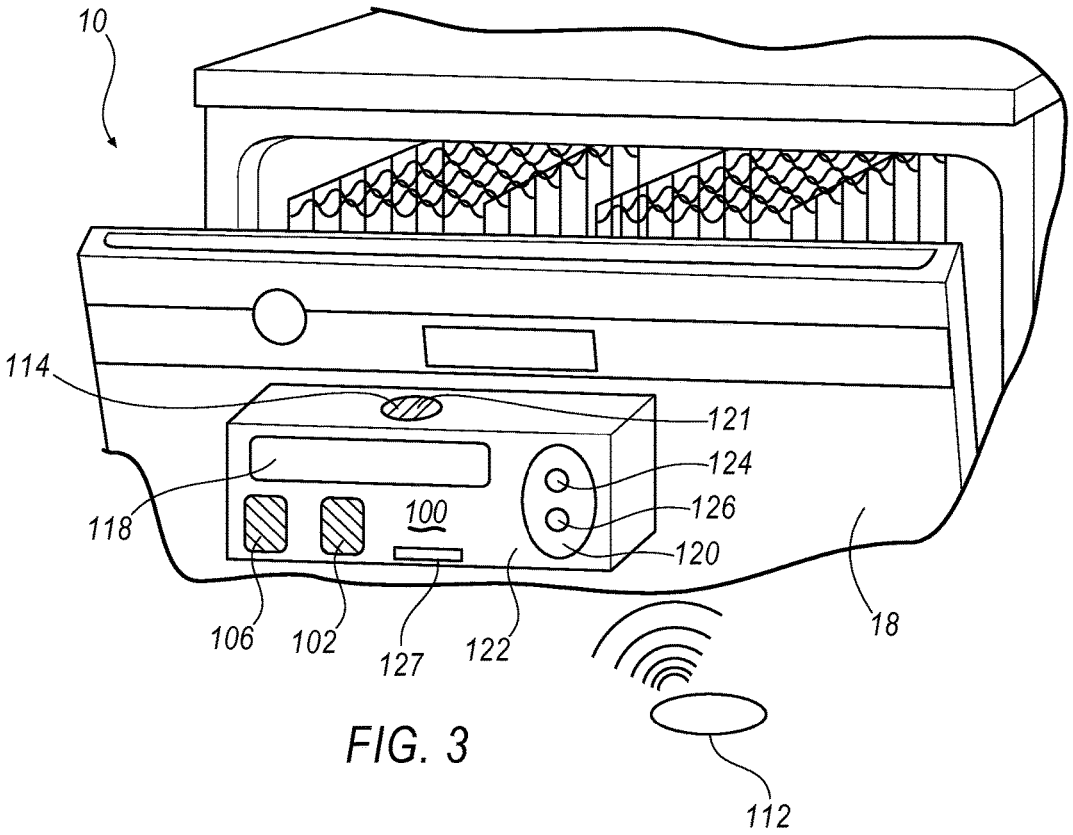
FIG. 3 is an exemplary illustration of a clean status indicator shown in FIG. 2 illustrated mounted on the exterior door surface of a dishwasher.

Referring now to FIG. 3, an exemplary illustration of one possible exemplary the clean status indicator 100 is shown mounted on the exterior door surface 18 of a dishwasher 10. Status indicator does not have to be mounted to the device so long as it still may communicate with its associated sensors (e.g., it could be positioned on a kitchen countertop) In the case of new devices, the logic discussed above may be incorporated into the internal operational mechanism of the device with the possible exception of sensors such as a weight sensor 112 and sound sensor 121, which may not exist. With respect to a retrofit approach as illustrated, the status indicator 100 may include a housing 122 that is configured to be adjacent to the washing compartment 16. In the illustrated approach involving a retrofitting of an existing device the status indicator may be removably mounted to the exterior door surface 18. In one arrangement this may include a magnetic attachment. In other exemplary arrangements a removable adhesive attachment may be utilized. The removable mount nature of the housing 122 allows for the ease of aftermarket installation on existing dishwashers 10. The housing 122 houses the controller 102, the power supply 106 and the visual display 118. In one exemplary arrangement the housing 122 may further hold the at least one temperature sensor 114 such that the at least one temperature sensor contacts or is at least adjacent the exterior door surface 18 when the housing 122 is removably mounted so that it can measure an appropriate change in temperature. In other exemplary arrangements, the temperature sensor 114 may be mounted remotely from the housing 122 such as in close proximity to weight sensor 112 so long as a change of temperature within the device during operation may be determined. Ideally in the case of retrofitting, no penetration into the washing compartment 16 takes place although with new dishwashers, it is anticipated that information from a pre-existing sensor 114 may be used for the additional information gathering discussed herein. Similarly, a sound sensor 121 may be used when appropriate so long as it is able to identify when device 10 is initially activated to complete one or more cleaning cycles. Sensor 121 may be within housing 122 or remote from it.

Nevertheless, in the disclosed exemplary retrofitting arrangement the weight sensor 112 is positioned remotely and communicates either through an associated wire or wirelessly with the controller 102. The manual override element 120 may be positioned on the housing 122 and include separate clean override 124 and dirty override 126 controls to allow a user to manually set the clean/dirty status 116 of the dishwasher's contents. In addition, a control surface 127 that can include button and inputs may be included to allow the user to input settings.

Figure 4:
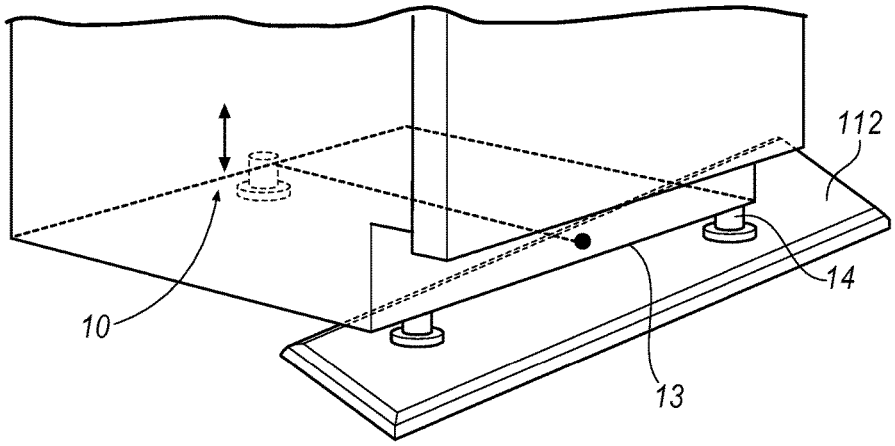
FIG. 4 is an exemplary illustration of a weight sensor for use in combination with the clean status indicator shown in FIG. 3.
Figure 5:
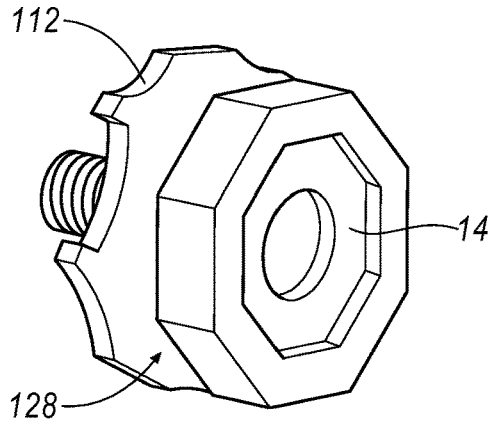
FIG. 5 is an exemplary illustration of an alternate weight sensor for use in combination with the clean status indicator shown in FIG. 3.
Figure 6:
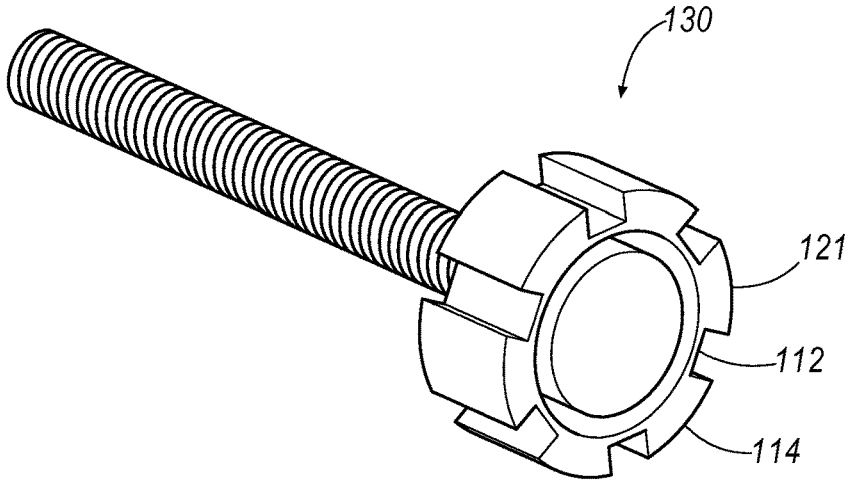
FIG. 6 is an exemplary illustration of an alternate weight sensor for use in combination with the clean status indicator shown in FIG. 3.

Referring now to FIG. 4, which is an exemplary illustration of a removable weight sensor 112 for use with the controller 102 illustrated in FIG. 3. The weight sensor 112 may be positioned underneath one or more of the supporting feet 14 of a dishwasher 10. As illustrated, the weight sensor is disposed between a bottom surface of at least one supporting foot 14 of the device and the ground. If two feet are used, it may be more accurately reflect the change in weight. The weight sensor 112 may wirelessly communicate weight data to the controller 102 for use by the status logic 104. In one exemplary arrangement, the weight sensor 112 is a passive sensor such that it does not require its own power supply. Alternatively sensor 112 may be incorporated into the base 13 of the device. For example, supporting feet 14 may comprise a portion of base 13 and as illustrated in FIG. 5, the weight sensor 112 may comprise a sensor formed as an insert washer 128 mounted directly onto the supporting feet 14 of a dishwasher 10 as opposed to under the base and under the feet as illustrated in FIG. 4. In still another exemplary arrangement illustrated in FIG. 6, the weight sensor 112 may be incorporated into a replacement foot element 130 configured to replace one or more feet of a dishwasher 10 in the case of retrofitting.

Figure 7:
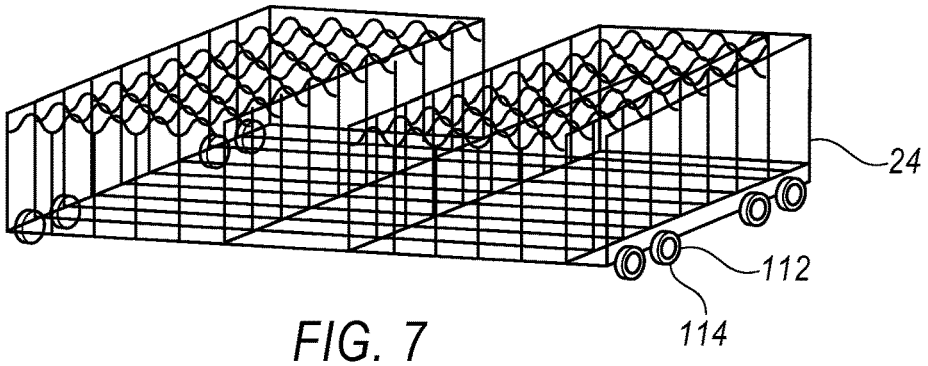
FIG. 7 is an exemplary illustration of an alternate weight sensor for use in combination with the clean status indicator shown in FIG. 3

In still another exemplary arrangement as illustrated in FIG. 7 weight sensor 112 may be incorporated into one or more of the movable racks 24 within the dishwasher. The racks 24 are configured to receive objects to be cleaned by the device and the weight sensor may adjust for the addition and subtraction of objects to the rack. Additionally or separately, if such a sensor 112 is utilized within the washing compartment 16, a temperature sensor 114 and/or a sound sensor 121 may also be used in the same location and as part of the same sensor unit, particularly if information is going to be transmitted wirelessly to controller 102 in the case of retrofitting to avoid physical penetration between the outer and inner portions of the device.

Figure 8:
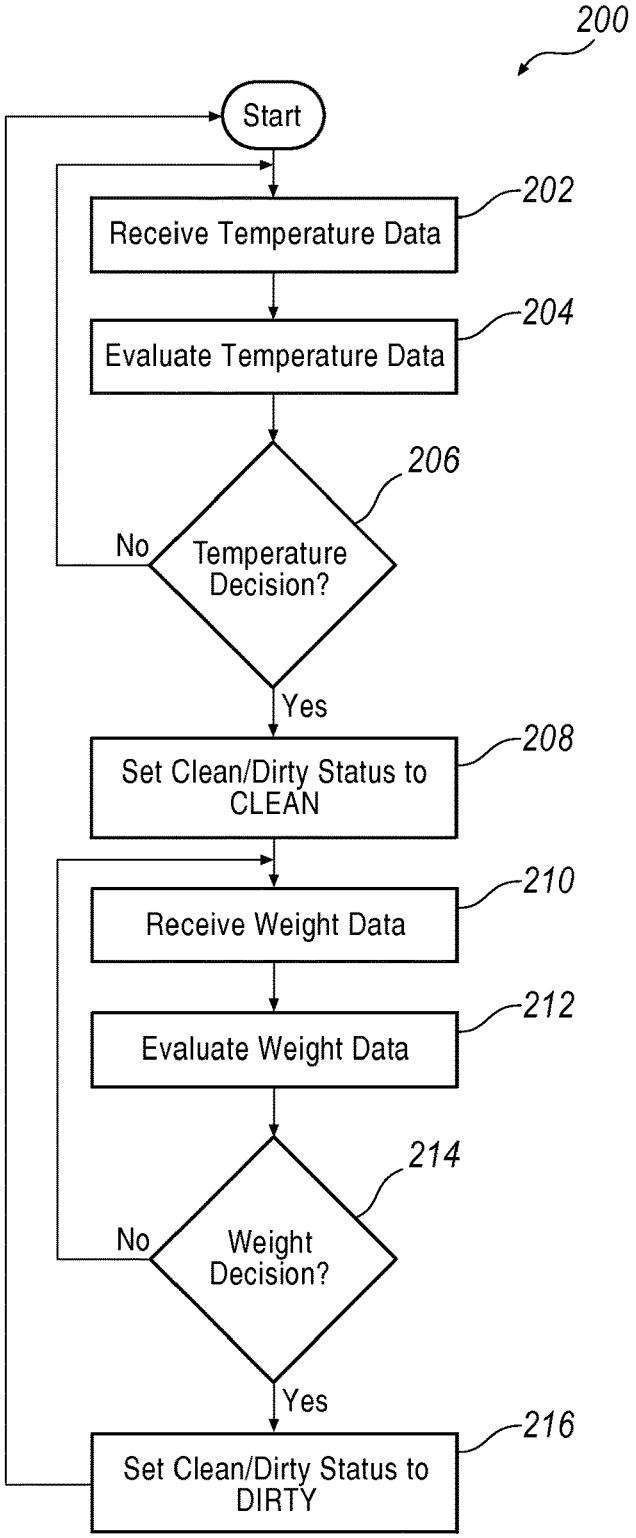
FIG. 8 is an exemplary chart of the status logic process for use in the clean status indicator.

FIG. 8 is an exemplary chart of the status logic 104 for use in the clean status indicator 100. The process 200 includes receiving temperature data 202 from the at least one temperature sensor 114. The data is evaluated to determine a dishwasher operating event 204. A temperature decision 206 is made by determining if a change of temperature is greater than a predetermined threshold and if the operating event is not found the process is restarted. If the operating event is found, the clean/dirty status is set to clean 208. In practice, the change in temperature is expected to be greater than an expected change in ambient temperature. While in many situations the temperature may increase since hot water aids in cleaning, in other cases the temperature may go down as with the use of cold water in an energy saving mode. The process 200 then receives weight data from the at least one weight sensor 210. The data is evaluated to determine if the dishwasher has been emptied 212. A weight decision 214 is made by comparing the weights to determine if a threshold has been met, and if the dishwasher has not been emptied the process 200 continues to monitor weight 210. If the dishwasher has been emptied the clean/dirty status is set to dirty 216 and the process 200 is restarted. The temperature data evaluation 204 and the weight data evaluation 212 may comprise simple delta changes in values or may implement more complex calculations. Additionally, calibrations are anticipated such that a first base weight provided to controller 102 may be an empty weight of the device while a second base weight provided to the controller 102 before a change of temperature may be the full weight of the device with objects to be cleaned. Similarly, an initial temperature may be an ambient temperature.

Figure 9:
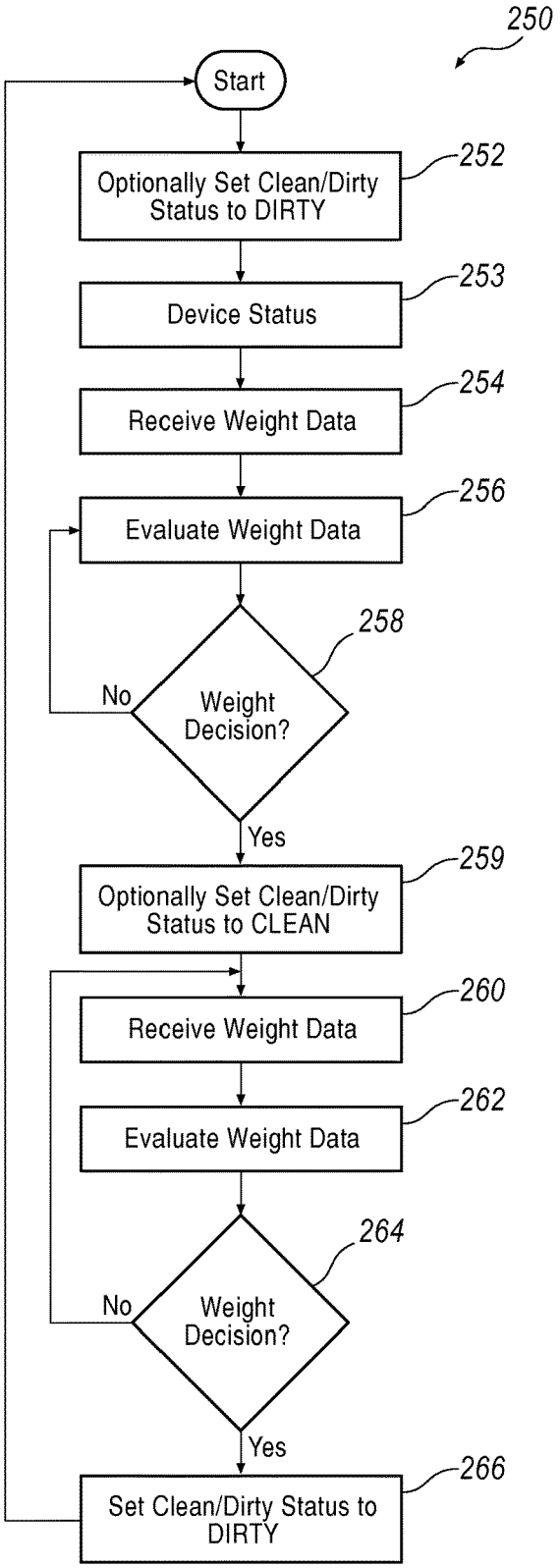
FIG. 9 is another exemplary chart of the status logic process for use in the clean status indicator.

In some situations an additional weight decision may be used in place of or as a supplement to temperature decision 206 as part of status logic 104 as illustrated in FIG. 9. In the illustration that follows it is assumed that weight sensor 112 is able to compare the weight of the entire device during operation as opposed to being associated with movable racks 24 as illustrated in FIG. 7. For example, as shown by way of exemplary process 250, the controller is told that the dishes are "dirty" 252. This determination may be done manually using manual override 120 or automatically by way of step 266 as discussed below.

An initial base weight is evaluated as shown by weight data evaluation 254 before the device cycles commence, but after the device is "full". Potentially, weight is recorded after a mechanical noise such as the starting of a device motor is recorded 253 by way of an additional sensor, sound sensor 121 right at the beginning of a first operational cycle for cleaning objects contained within the washing compartment 16. In the case of a device having a device status indicator 100 integrated when originally constructed or in the case of some retrofitting approaches, the base weight may be measured when one hits the "start" button and no sound sensor 121 may be necessary. Water is added to washing compartment 16 as part of at least one cleaning cycle and removed. The change of weight is received at block 256 wherein the weight of the added water is greater than the initial base weight. The fact that the weight changed beyond a first object weight threshold that reflects an increase of weight from the base weight when water is added may be recorded as shown at decision point 258 and an identification that the device has been subjected to one or more cycles captured by the controller 102. The visual display 118 may be updated at 259 by controller 102 for changing the status from "Dirty" to "Clean" Then the process continues as with FIG. 8 such that it captures when the weight of items within the washing compartment 16 fall below a threshold level representing a second object weight threshold as shown by receiving weight data at block 260, evaluating the weight data as shown at block 262, and then determining if the drop in weight from the initial base weight is greater than a threshold level as shown at decision point 264. If the device has been emptied the clean/dirty status is set to "Dirty" 266 by way of controller 102 and the process 250 is restarted. In this approach the increase in weight of the device based on an initial base weight identifies that a cycle has commenced and the decrease in weight of the device based on the initial base weight identifies that the device has been emptied of the cleaned objects and is ready to be filled again for cleaning.

Figure 10:
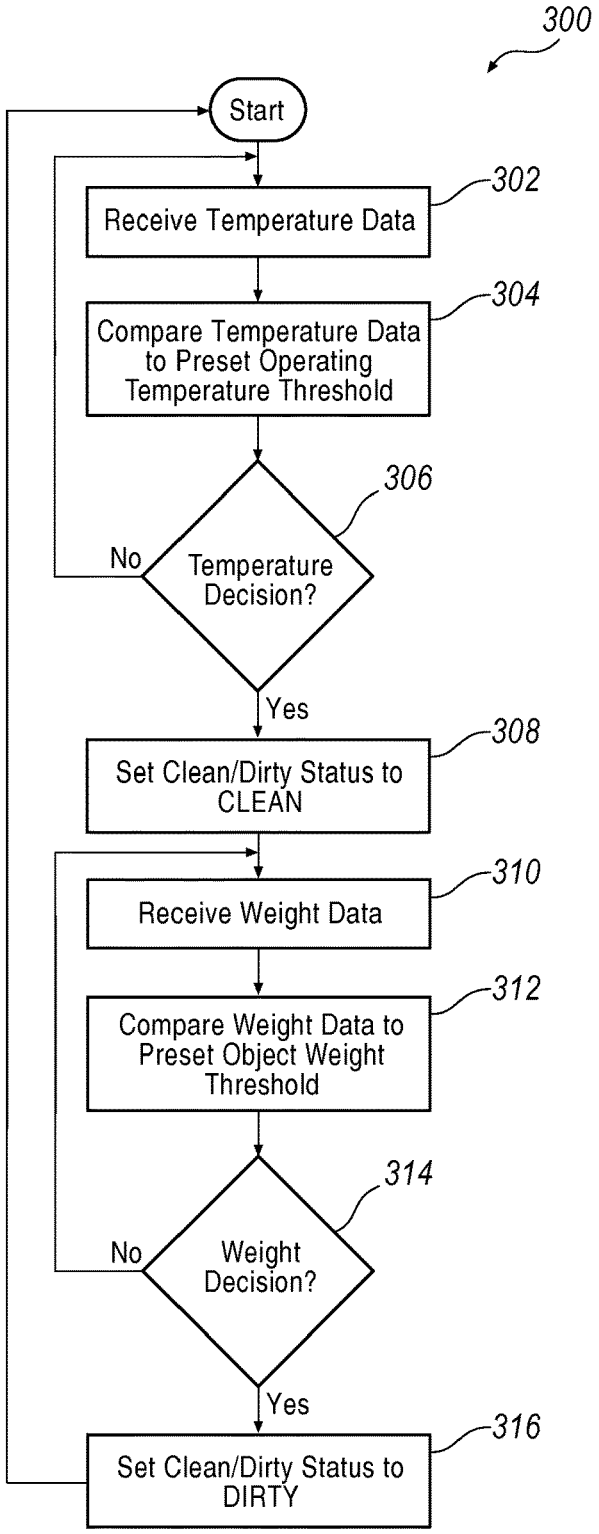
FIG. 10 is another exemplary chart of the status logic process for use in the clean status indicator.

Referring now to FIG. 10, which is another exemplary chart of the status logic 104 for use in the device status indicator 100. The process 300 includes receiving temperature data from the at least one temperature sensor 302. The data is compared to a preset operating temperature threshold to determine a device operating event 304. In one exemplary arrangement the preset operating temperature threshold is set by the manufacturer. In another exemplary arrangement the preset operating temperature threshold is owner defined. This may be accomplished through the control surface 127. The owner may manually enter a value, or may simply hold down a portion of the control surface 127 while the device is operating to set the preset operating temperature threshold. A temperature decision 306 is made and if the preset operating temperature threshold has not been exceeded the process is restarted. If the preset operating temperature threshold has been exceeded, the clean/dirty status is set to clean 308. The process 300 then receives weight data from the at least one weight sensor 310. The data is compared to a preset object weight threshold to determine if the device has been emptied 312. A weight decision 314 is made and if the weight data is not below the preset object weight threshold the process 300 continues to monitor weight 310. If the weight data is less than the preset object weight threshold the clean/dirty status is set to dirty 316 and the process 300 is restarted. In one exemplary arrangement the preset object weight threshold is set by the manufacturer. In another exemplary arrangement the preset object weight threshold is owner defined. The owner may manually enter a value, or may simply hold down a portion of the control surface 127 while the device is either empty or full of a desired minimum number of objects. This allows a user to accommodate a minimum number of dishes that may not have been adequately cleaned while still allowing the process 300 to set the clean/dirty status to dirty 316. Additionally, it further allows the user to partially unload the device and still have the process 300 maintain the clean/dirty status as clean 308 as long as the weight data remains above the preset object weight threshold.

Figure 11:
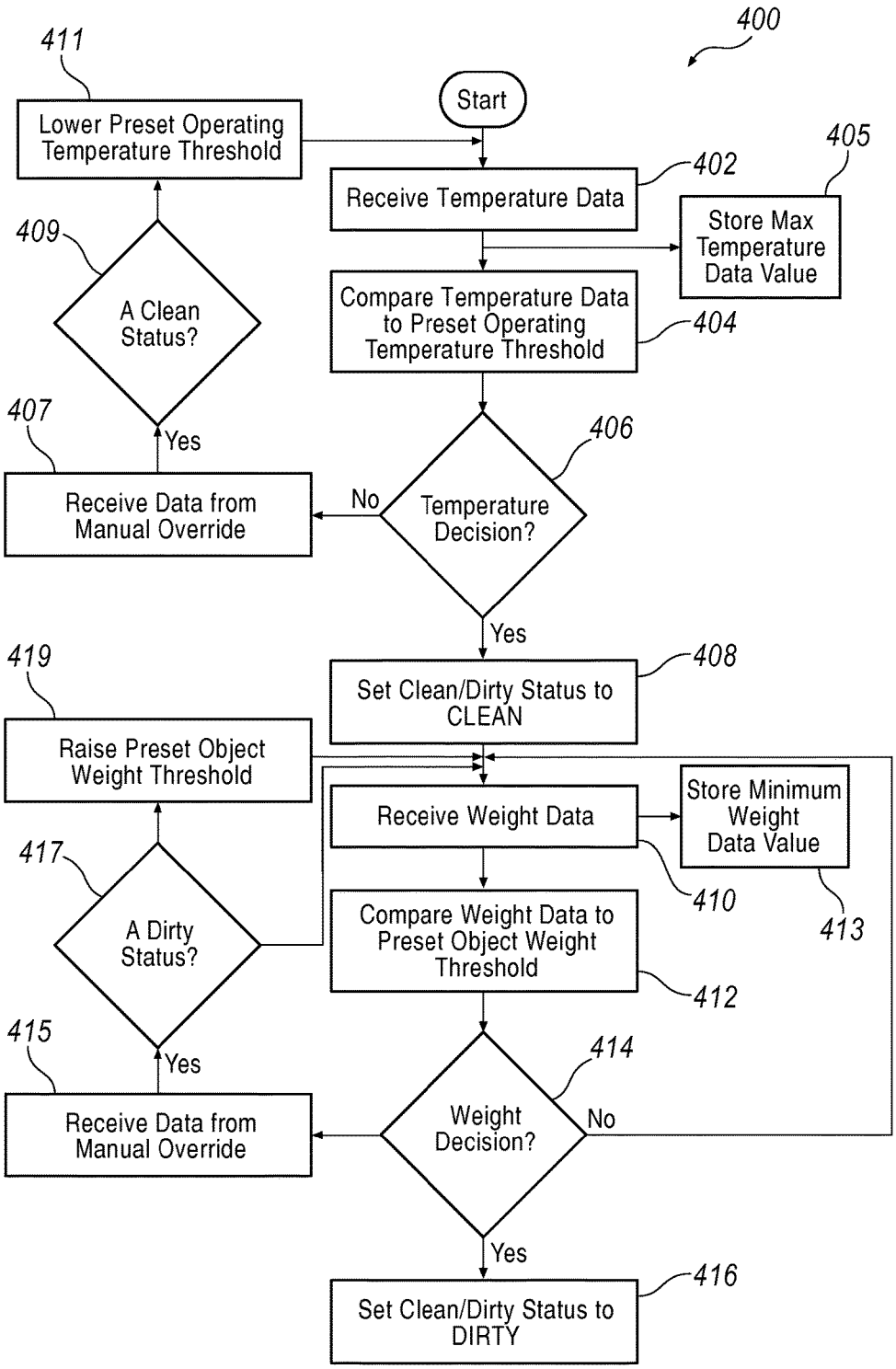
FIG. 11 is another exemplary chart of the status logic process for use in the device status indicator.

Referring now to FIG. 11, which is another exemplary chart of the status logic 104 for use in the device status indicator 100. The process 400 includes receiving temperature data from the at least one temperature sensor 402. The data is compared to a preset operating temperature threshold to determine a device operating event 404. A maximum temperature may be stored during this process 405. The preset operating temperature may be set by the manufacturer or by the user as previously described. A temperature decision 406 is made and if the preset operating temperature threshold has not been exceeded the process 400 receives data from the manual override 407. The process 400 determines if a manual override indicates a clean status 409. If the manual override indicates that the user has assigned a clean status even though the preset operating temperature threshold has not been exceeded the preset operating temperature 411 is lowered and the process is restarted. In one exemplary arrangement the preset operating temperature may be incrementally decreased. In this example, the status indicator 100 will slowly adapt to the individual characteristics of the users particular device. In another exemplary arrangement, the preset operating temperature by be decrease to the maximum temperature stored 405. In this example, the user need only make a single manual override after installation to set the status indicator 100 to match the user's particular device.

If the preset operating temperature threshold has been exceeded, the clean/dirty status is set to clean 408. The process 400 then receives weight data from the at least one weight sensor 410. The data is compared to a preset object weight threshold to determine if the device has been emptied 412. A minimum weight may be stored 413 during this process. A weight decision 414 is made and if the weight data is not below the preset object weight threshold the process 400 receives data from the manual override 415. The process 400 determines if a manual override indicates a dirty status 417. If the manual override indicates that the user has assigned a dirty status even though the preset object weight threshold has been exceeded the preset object weight threshold 419 is raised and the process is restarted. In one exemplary arrangement the preset operating temperature may be incrementally increased. In this example, the status indicator 100 will slowly adapt to the individual characteristics of the users particular device as well as the characteristics of the user. If a user occasionally leaves one or two dishes or several pieces or silverware, the status indicator 100 will adapt to still set the status to dirty. In another exemplary arrangement, the preset object weight threshold may be set to the stored minimum weight. In this example, a user need only make a single manual override after installation to set the status indicator to match the user's particular device or tailor it to their habits.

Accordingly, it is to be understood that the above description is intended to be illustrative and not restrictive. Many embodiments and applications other than the examples provided would be apparent upon reading the above description. For example, sound sensor 121 may be used in other approaches other than that discussed for FIG. 9 to provide an additional indication that at least one cleaning cycle has commenced and to permit the calibration of weights and temperatures from sensors 112 and 114 that are then compared with thresholds. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

It should be understood that the controller 102 and the status logic 104 may include computer-executable instructions such as the instructions of the software applications on a processor, where the instructions may be executable by one or more computing devices. In general, a processor (e.g., a microprocessor) receives instructions, (e.g., from a memory), a non-transitory computer-readable medium, etc., and executes these instructions, thereby performing one or more processes, including one or more of the processes described herein. Such instructions and other data may be stored and transmitted using a variety of computer-readable media. Computing systems and/or devices generally include computer-executable instructions, where the instructions may be executable by one or more devices such as those listed below. Computer-executable instructions may be compiled or interpreted from computer programs created using a variety of programming languages and/or technologies, including, without limitation, and either alone or in combination, Java™, C, C++, Visual Basic, Java Script, Perl, etc. The controller 102 and the status logic 104 may take many different forms and include multiple and/or alternate components and facilities. Indeed, additional or alternative components and/or implementations may be used, and thus the above controller examples should not be construed as limiting.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A clean status indicator for use on a dishwasher, the dishwasher including a frame with a base, a washing compartment within the frame, a door having an interior door surface and an exterior door surface, and at least one rack positioned within the washing compartment, the clean status indicator comprising:

at least one weight sensor configured to removably mount to the device externally of the washing compartment of the dishwasher, the weight sensor configured to sense the weight of objects within the washing compartment;

at least one temperature sensor configured to monitor the temperature within the washing compartment;

a housing configured to removably mount to the exterior door surface;

a power supply contained within the housing;

a visual display positioned within the housing for conveying a clean/dirty status of objects within the washing compartment;

a controller positioned within the housing and in communication with the at least one temperature sensor, the at least one weight sensor, and the visual display, the controller including a status logic configured to receive data from the at least one temperature sensor and the at least one weight sensor; and wherein the at least one weight sensor selectively has a first object weight threshold that reflects an increase of weight from a base weight when water is first added to the washing compartment, and a second object weight threshold that reflects a decrease in weight from a base weight when objects are removed from the washing compartment, the at least one temperature sensor selectively having a preset temperature threshold, the visual display reflecting "clean" when at least one of the first object weight threshold and the preset temperature threshold is met and the visual display reflecting "dirty" when the second object weight threshold is met.

2. A clean status indicator as described in claim 1, wherein the preset object weight threshold is user definable.

3. A clean status indicator as described in claim 1, further comprising:

a manual override element positioned on the housing, the manual override element configured to allow a user to manually adjust a determination of the clean/dirty status.

4. A clean status indicator as described in claim 3, wherein the status logic is configured to utilize data from the at least one weight sensor and the manual override element to adaptively modify the preset object weight threshold.

5. A clean status indicator as described in claim 1, wherein one or more of the at least one weight sensors and the at least one temperature sensors are in wireless communication with the controller.

6. A clean status indicator as described in claim 1, wherein the at least one temperature sensor is configured to be mounted externally of the washing compartment.

7. A method for monitoring the clean/dirty status of a dishwasher including a frame with a base, a washing compartment within the frame, a door having an interior door surface and an exterior door surface, and at least one rack positioned within the washing compartment, comprising:

removably mounting a controller, a visual display, and a temperature sensor to the exterior door surface, the temperature sensor monitoring the temperature within the washing compartment;

removably mounting a weight sensor to the device externally of the washing compartment of the dishwasher, the weight sensor sensing the weight of objects within the washing compartment;

receiving data from the temperature sensor and the weight sensor using the controller;

evaluating the data from the temperature sensor to determine if the dishwasher has been operated using a status logic within the controller;

setting the clean/dirty status to clean if the data from the temperature sensor indicates the dishwasher has been operated;

evaluating the data from the weight sensor to determine if the dishwasher has been emptied using the status logic within the controller;

setting the clean/dirty status to dirty if the data from the weight sensor indicates the dishwasher has been emptied;

displaying the clean/dirty status on the visual display;

comparing the data from the temperature sensor with a preset operating temperature threshold; and comparing the data from the weight sensor with a preset object weight threshold;

receiving data from a manual override element, the manual override element configured to allow a user to manually adjust a determination of the clean/dirty status;

using the data from the manual override element and the data from the temperature sensor for adjusting the preset operating temperature threshold; and using the data from the manual override element and the data from the weight sensor for adjusting the preset object weight threshold.

8. A clean status indicator for use with a device including a frame with a base, a washing compartment within the frame, a door having an interior door surface and an exterior door surface, the clean status indicator comprising:

at least one weight sensor configured to mount to the device, the weight sensor configured to sense the weight of objects within the washing compartment;

at least one temperature sensor configured to monitor the temperature within the washing compartment;

a housing adjacent the washing compartment;

a power supply;

a visual display positioned within the housing for conveying a clean/dirty status of objects within the washing compartment;

a controller in communication with the power supply, the at least one temperature sensor, the at least one weight sensor, and the visual display, the controller including a status logic configured to receive data from the at least one temperature sensor and the at least one weight sensor, utilize the data to determine the clean/dirty status of objects within the washing compartment, and display the clean/dirty status on the visual display;

wherein the status logic selectively compares the data from the at least one temperature sensor to a preset operating temperature threshold;

wherein the status logic compares the data from the at least one weight sensor to a preset object weight threshold to alter the clean/dirty status; and wherein the at least one weight sensor selectively has a first object weight threshold that reflects an increase of weight from a base weight when water is first added to the washing compartment and a second object weight threshold that reflects a decrease in weight from a base weight when objects are removed from the washing compartment, the status indicator reflecting "clean" when at least one of the first object weight threshold and the preset temperature threshold is met and the status indicator reflecting "dirty" when the second object weight threshold is met.

9. The clean status indicator as described in claim 8, wherein the at least one weight sensor is disposed between a bottom surface of at least one supporting foot of the device and the ground.

10. The clean status indicator as described in claim 8, wherein the at least one weight sensor replaces at least one supporting foot of the dishwasher.

11. The clean status indicator as described in claim 8, wherein the device is a dishwasher and at least one second weight sensor is mounted to at least one rack within the washing compartment, and the temperature sensor is mounted to the at least one rack within the washing compartment, the at least one rack configured to receive objects to be cleaned by the device and the weight sensor adjusting for the addition and subtraction of objects to the at least one rack.

12. The clean status indicator as described in claim 11, wherein the at least one second weight sensor and the temperature sensor are in wireless communication with the controller.

13. The clean status indicator as described in claim 8, further comprising:

a manual override element positioned on the housing, the manual override element configured to allow a user to manually adjust a determination of the clean/dirty status.

14. The clean status indicator as described in claim 8, wherein the status logic compares the data from the at least one temperature sensor to the preset operating temperature threshold to determine the clean/dirty status; and wherein the status logic compares the data from the at least one weight sensor to a preset object weight threshold to alter the clean/dirty status.

15. A clean status indicator as described in claim 14, wherein the preset operating temperature threshold and the preset object weight threshold are user definable.

16. A clean status indicator as described in claim 14, further comprising:

a manual override element positioned on the housing, the manual override element configured to allow a user to manually set the clean/dirty status;

wherein the status logic is configured to utilize data from the manual override element to modify at least one of the preset operating temperature threshold and the preset object weight threshold.

17. The clean status indicator as described in claim 8, further comprising a sound sensor that is triggered when the device enters a first cleaning cycle, the weight sensor recording the base weight when the sound sensor is triggered for use with the first object weight threshold and the second object weight threshold.

* * * * *